US006158176A

United States Patent [19]

Perdue

[11] Patent Number: 6,158,176

[45] **Date of Patent: *Dec. 12, 2000**

[54] CORE FOR A SOUND ABSORBING PANEL

[76] Inventor: Jay Perdue, Rte. 6 Box 105, Amarillo, Tex. 79124

[ * ] Notice: This patent is subject to a terminal disclaimer.

[21] Appl. No.: 08/825,515

[22] Filed: Mar. 31, 1997

Related U.S. Application Data

[63] Continuation-in-part of application No. 08/398,868, Mar. 6, 1995, Pat. No. 5,644,872.

[51] Int. Cl.[7] ..... E04B 1/82

[52] U.S. Cl. ..... 52/144; 52/791.1; 181/284; 181/291; 428/193

[58] Field of Search ..... 52/144, 145, 406.2, 52/791.1; 181/284, 286, 290, 291; 428/192, 193, 194

[56] References Cited

U.S. PATENT DOCUMENTS

| | | | |
|---|---|---|---|
| 4,594,278 | 6/1986 | Nixon | 428/68 |
| 4,611,445 | 9/1986 | Pressley | 52/144 |

*Primary Examiner*—Carl D. Friedman
*Assistant Examiner*—Yvonne M. Horton
*Attorney, Agent, or Firm*—Norman B. Rainer

[57] ABSTRACT

A core for the production of a rectangular acoustic panel includes a mat of rockwool bounded by flat front and rear surfaces, and having a density between 5 and 9 pounds per cubic foot, a thickness between 0.75 and 2.0 inches, and a binder content between 3% and 5%. A sheet of non-woven interbonded fiberglass is adhered to at least one flat surface of the rockwool mat, the sheet having a thickness between 20 and 30 mils.

9 Claims, 1 Drawing Sheet

Fig.1
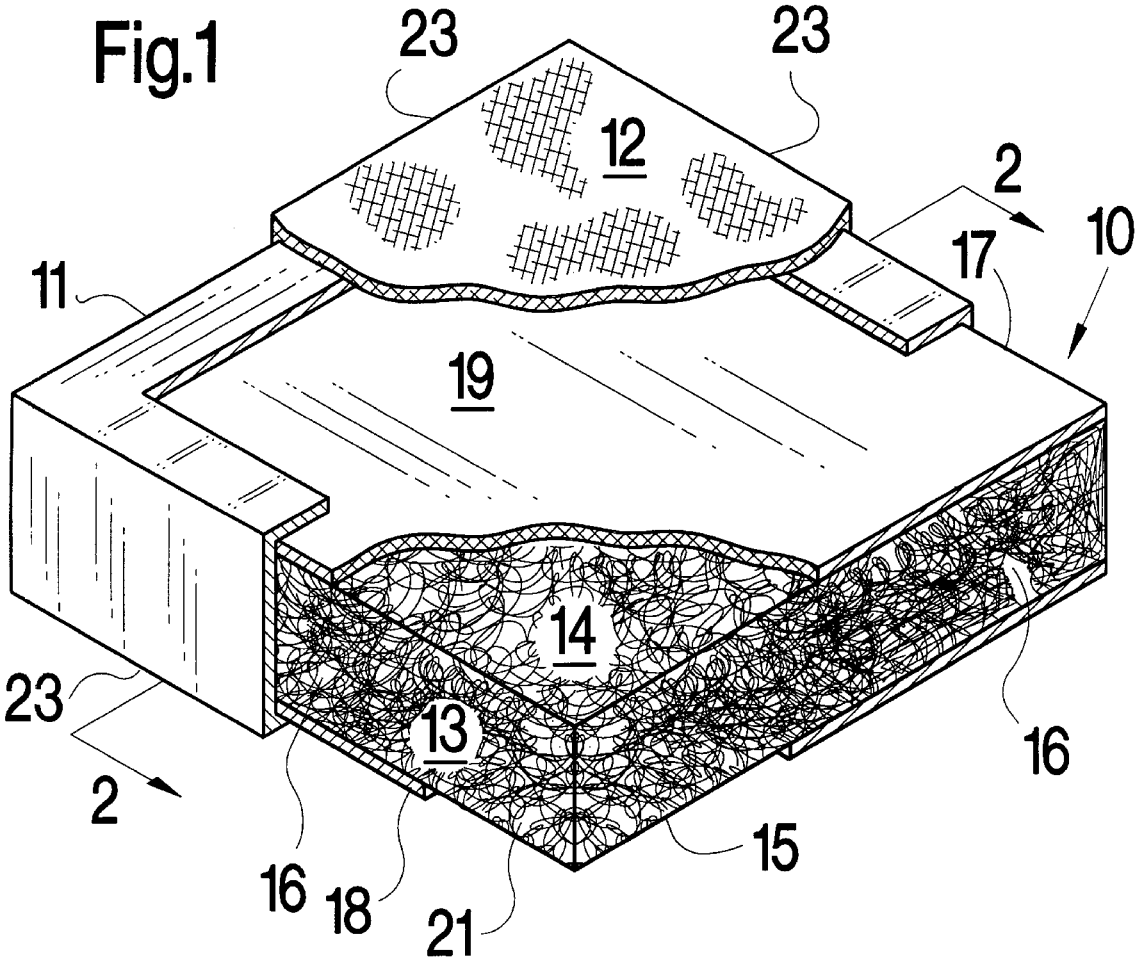
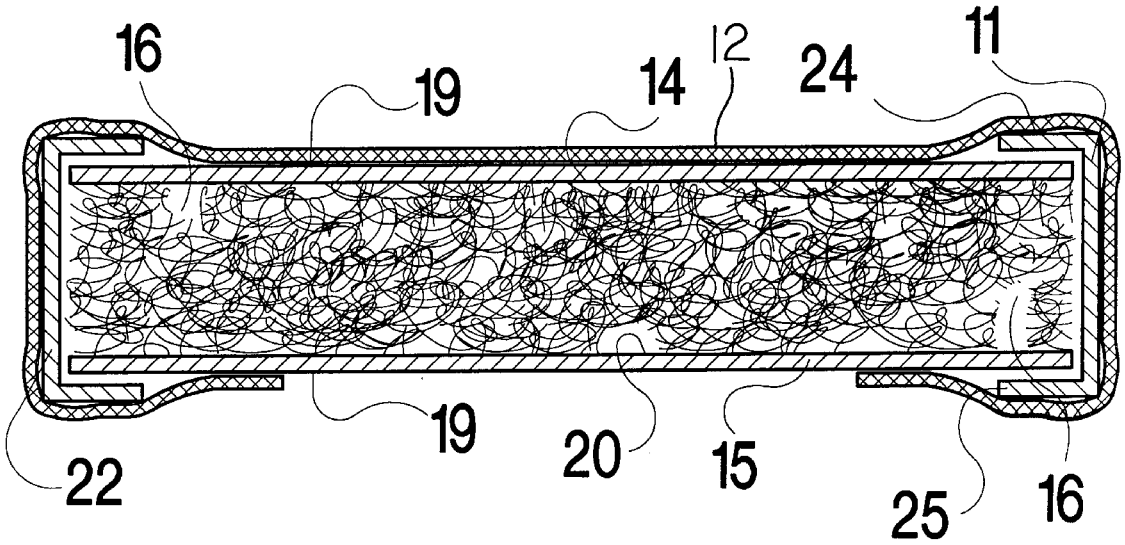
Fig.2

CORE FOR A SOUND ABSORBING PANEL

RELATED APPLICATIONS

This application is a continuation-in-part of U.S. patent application Ser. No. 08/398,868, filed Mar. 6, 1995, now U.S. Pat. No. 5,644,872.

BACKGROUND OF THE INVENTION

1. Field of the Invention

This invention concerns self-supporting cores which, when framed produce sound-absorbing panels intended to be attached to indoor walls and ceilings of buildings.

2. Description of the Prior Art

It is often sought to diminish the noise level in indoor rooms, auditoriums, gymnasiums, restaurants, hallways, manufacturing plants and other indoor areas. Various types of sound-absorbing rigid panel products have been employed as ceiling tiles, and various rigid and soft wall coverings have been disclosed for sound absorption.

In general, prior sound-absorbing materials have either been difficult to install or have been deficient with respect to other requirements, such as physical properties and fireproof characteristics. Panels of framed rectangular construction have been fabricated of fiberglass batting for application to indoor room surfaces. Although fiberglass panels provide good thermal insulation, their acoustic absorption characteristics and aesthetic appearance are generally poor. Such panels are also easily susceptible to physical damage as a result of abrasion or impact, as by a ball.

Products made of "rockwool," sometimes called "mineral wool," have been employed in the building industry in the form of loose batting used for thermal insulation. Rockwool is generally produced by the centrifugal spinning of molten mineral magna. The resultant fibers, unlike fiberglass fibers, are of indeterminate length, and are intermingled as a loose batting resulting from their manner of production.

Batting products, whether of fiberglass or rockwool can have various bulk densities, depending upon the degree of compaction of the fibers, the specific gravity of the fibers, and the amount of binder which may be employed to impart dimensional stability to the structure. When the batting is formed into a shape-retaining self-supporting flat structure intended for use in the production of panels, that structure is often referred to as a "mat." As disclosed in parent application Ser. No. 08/398,868, mats of rockwool have been found to be vastly superior to mats of fiberglass with respect to acoustic absorption.

It has been found, however, that when a rockwool mat structure is of sufficient density to have good dimensional stability, it has poor acoustic absorption properties. Conversely, when the mat is of very low density, it is frail, having poor dimensional stability but having good acoustic absorption properties. Panels are made by causing a rigid frame to engage the rectangular perimeter of a mat, the mat now being referred to as the "core" of the panel. Although the frame imparts some structural stability to the overall panel construction, the frame in itself cannot correct problems inherent to frail cores. One problem of particular concern in panels employing frail cores is that sagging of the core will occur, especially in panels of 2 foot square size and larger. Other problems encountered with frail cores include: shedding of fibers, predisposition to forming permanent depression where compressively contacted by any object, and tearing during installation or subsequent handling.

It is accordingly an object of the present invention to provide a rectangular core structure for producing an acoustic panel having superior sound-absorbing characteristics.

It is another object of this invention to provide a core structure as in the foregoing object having acceptable characteristics relative to non-spreading of fire.

It is a further object of the present invention to provide a core of the aforesaid nature having superior compressive strength.

It is still another object of this invention to provide a core of the aforesaid nature having improved resistance to sagging.

It is yet another object of the present invention to provide a core of the aforesaid nature which produces a panel of pleasing appearance.

These objects and other objects and advantages of the invention will be apparent from the following description.

SUMMARY OF THE INVENTION

The above and other beneficial objects and advantages are accomplished in accordance with the present invention by a core for the production of a rectangular acoustic panel, said core comprising:

a) a mat of rockwool bounded by flat front and rear surfaces and four straight perimeter edges disposed in a rectangular array, said mat having a density between 5 and 9 pounds per cubic foot (lbs./cu.ft ), a thickness between 0.75 and 2.0 inches, and a binder content of between 3% and 5% by weight of said mat, and b) a sheet of non-woven interadhered fiberglass bonded to at least one flat surface of said rockwool mat, said sheet having a thickness between 20 and 30 mils.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing:

FIG. 1 is a top perspective view of an embodiment of the core of this invention with portions broken away to reveal interior details, and further showing portions of a frame member which converts the core into a panel product.

FIG. 2 is a sectional view taken in the direction of the arrows upon the line 2—2 of FIG. 1.

DESCRIPTION OF THE PREFERRED EMBODIMENT

Referring to FIGS. 1 and 2, an embodiment of the core 10 of the present invention is shown in combination with frame 11 and cloth facing 12 to produce a sound-absorbing acoustic panel suitable for mounting upon a wall or ceiling of a room.

Said core is comprised of a mat of rockwool 13 bounded by flat front and rear surfaces 14 and 15, respectively, and four straight perimeter edges 16 disposed in a rectangular array. Said mat has a density between 5 and 9 pounds per cubic foot and a thickness between 0.75 and 2.0 inches. It has been found that, at densities below 5 lbs./cu.ft., the mat has insufficient rigidity to be useful in acoustic panels. At densities greater than 9 lbs./cu.ft., the mat provides insufficient sound absorption in acoustic panels. The thickness of the rockwool mat should be at least 0.75 inch in order to provide adequate sound absorption. Thicknesses greater than two inches do not afford significant further sound absorption, and have been found to cause bulging in the center of large panels.

The relatively thin rockwool mats employed in the cores of this invention are derived from much thicker "boards" or "loaves" of rockwool fibers produced on a production line conveyor belt.

The individual rockwool fibers of the rockwool board or mat are interbonded with a bonding agent typically of a thermoset chemical nature. Exemplary bonding agents include: phenol-formaldehyde, urea-formaldehyde and melamine-formaldehyde compositions. Such compositions, in low viscosity aqueous formulations, are sprayed onto the rockwool fibers freshly formed and deposited upon the conveyor belt in a manner to achieve uniform treatment. The treated fibers are then pressed to the desired degree of compaction and routed through a curing oven where the water solvent is driven off and the bonding agent undergoes chemical cross-linking to a cured thermoset state. Sufficiently small amounts of the bonding agent composition is employed so as to avoid occlusion of the interstitial spaces between fibers. Instead, because of its low viscosity, the formulation merely coats the fibers, and the coating flows until it meets a cross contacting fiber. The formulation remains at the cross over site of said contacting fibers until curing occurs. By virtue of such method of interbonding, the intrinsic properties of the rockwool fibers are unaffected, and the collective characteristics of the mat are not compromised. The preferred amount of bonding agent in the rockwool mat is about 3% to 5% based upon the overall weight of the mat. Lesser amounts of bonding agent will not secure adequate integration of the mat, and greater amounts of bonding agent will diminish certain sought properties of the mat.

Front and rear sheets 17 and 18, respectively, fabricated of non-woven interbonded fiberglass are adhered to the front and rear surfaces, respectively, of mat 13. Said sheets are preferably white, having a thickness between 20 and 30 mils. and having smooth interior and exterior surfaces 19 and 20, respectively. The sheets are preferably made from continuous length borosilicate glass fibers laid in a swirl pattern and interadhered with a non-discoloring bonding agent such as a urea-formaldehyde resin. The bonding agent may typically comprise between about 14% and 22% of the total weight of the fiberglass sheet. The fiberglass sheets are consequently of high strength and uniform texture. The individual glass fibers have a diameter between 0.0001 and 0.001 inch, a tensile strength of about 500,000 p.s.i., and elongation to break of about 4.8%. The fiberglass sheet may have a weight in the range of 0.75 to 3 ounces/square foot, and has a tensile strength preferably greater than 25 pounds/inch, and an Elmendorf tear strength greater than 350 grams.

In certain embodiments, only the front fiberglass sheet is employed. The fiberglass sheets enhance the stability and durability of the rockwool mat. Furthermore, because of the critically selected characteristics of the fiberglass sheets, in conjunction with specialized aspects of the rockwool mat, the fiberglass sheets do not adversely affect the sound-absorbing characteristics of the core. In fact, the fiberglass has been found to enhance sound absorption in certain sound frequency ranges. Adhesive agents secure the fiberglass mats to the flat surfaces of the rockwool mat, forming a sandwich core assembly when two sheets are employed. The rockwool mat and fiberglass sheets are of identical rectangular perimeter, and are aligned so as to provide a rectangular core perimeter 21.

The adhesive agents employed in adhering the fiberglass sheets to the rockwool mat are preferably compositions wherein a pre-formed polymer is either dissolved in or dispersed in a volatile liquid vehicle. The composition is of sufficiently low viscosity to permit application by low pressure spray equipment, suitable viscosities being in the range of 600 to 800 centipoise. The solids content of the composition is at least 25%, thereby minimizing the volume of the composition required to achieve adhesion, and causing the adhesive to be deposited upon surface fibers only and without occluding the porosity of either substrate. The polymer is preferably of tacky constitution, whereby interadhesion of polymer-treated contiguous surfaces is achieved merely upon contact. Suitable polymers include, for example, copolymers of styrene and butadiene. The composition is preferably colorless or white, whereby no discoloration is imparted to the white fiberglass sheet. The adhesive composition is applied in minimal amounts to both the fiberglass sheet and rockwool mat surfaces, and said adhesive-treated surfaces are then pressed together. Because of the nature of the adhesive and its manner of application, there is no adverse affect upon the sound-absorbing properties of the core.

Although the cores of this invention may be directly adhered to wall or ceiling surfaces for sound attenuation purposes, the cores are preferably converted into panels by way of the addition of a frame and a decorative fabric cover. Referring to FIGS. 1 and 2, frame 11 is disposed about core perimeter 21. Said frame is comprised of four identical elongated straight sections 23. Each section 23 is further comprised of paired spaced apart front and rear sidewalls 24 and 25, respectively, disposed to lie against the flat surfaces of core 10, and an end wall 22 disposed orthogonally to said sidewalls as a continuous integral extension thereof. Sections 23 accordingly have a uniform U-shaped trough-like cross sectional configuration. End wall 22 is disposed to abut against an edge 16 of said core. The four sections 23 are preferably emplaced with the aid of adhesives. Frame 13 may be of metal or plastic construction, and facilitates the interabutment of adjacent panels in producing a continuous wall structure.

Cloth facing 12 is fabricated of fiberglass or other synthetic, preferably non-flammable fibers. Said facing is tautly disposed upon and adhered to front sheet 17 of the core assembly, and extends around said perimeter edges and onto rear sheet 18. In fact, a further advantage of the utilization of fiberglass sheet in the production of the core of this invention is that, whereas the cloth can be adhered to a fiberglass sheet, it cannot be adhered directly to the rockwool mat.

Means may be associated with the rear of the panel for attachment to a wall surface. Such attachment means may be in the form of a releasible securing structure. The panel may alternatively be bonded to a wall surface by way of an adhesive composition applied to the exterior surface of sheet 18.

Panels produced from the cores of the present invention will pass the fire test prescribed by ASTM-84-89 Class A, providing a flame spread reading of 20 and smoke developed reading of 115.

The core has a compressive resistance of between 400 and 500 lbs./ft.$^2$ at 10% compression. Accordingly, when the core of this invention is impacted, as by a ball, there is 95% immediate recovery from deformation. The remaining 5% recovery is slowly achieved.

When tested for sound absorption by way of ASTM C423-90a test, the core of this invention provides values above 0.85. The dimensions of the core and resultant panel may range from about 2'×2' to 4'×10'.

A further understanding of my invention will be had from a consideration of the following examples which illustrate certain preferred embodiments. All parts and percentages are by weight unless otherwise indicated. It is understood that the instant invention is not to be construed as being limited by said examples or by the details therein.

EXAMPLE 1

Cores of the present invention were produced from rockwool mats derived from boards having a 7 lb./cu.ft. density, 4% binder content, and 250 lbs./ft.$^2$ compressive strength. The mats were produced by slicing to 1" thickness and rectangular perimeter production line boards manufactured by the Roxul company of Toronto, Canada as ROXUL 80. The slicing provides a much flatter surface than the as-produced upper surface of the production line boards. The flat, sliced surface is necessary to facilitate adhesion to a fiberglass sheet.

The fiberglass sheet employed in producing the cores was of uniform 25 mil. thickness and comprised of non-woven continuous fiberglass filaments oriented in a random swirl pattern and bonded with a urea formaldehyde resin that preserves the whiteness of the sheet. The sheet, manufactured by the Manville Company of Toledo, Ohio, has a tensile strength of 35 lbs./inch and an Elmendorf tear strength of 450 grams.

The fiberglass sheet was adhered to the sliced flat surface of the rockwool mat employing an adhesive sprayed upon both matting surfaces; the adhesive composition being Camie 363B, sold by Camie-Campbell, Inc. of St. Louis, Mo. Said adhesive composition is a solution of a styrene-butadiene copolymer in hexane/acetone solvent, said solution having a viscosity of 700 centipoise, and a solids content of 28%. Because of its high volatility and high solids content, the adhesive does not migrate beyond its initial site of contact, and rapidly achieves a tacky state.

Test specimens were cut from cores made in the aforesaid manner, one core having two fiberglass sheets and the other core having just one fiberglass sheet. The specimens measured 1" thick, 2½" wide and 48" long. A test specimen of identical dimensions was also cut from the rockwool mat without the addition of a fiberglass sheet. The three test specimens were horizontally supported upon centers spaced 46" apart. After three days standing at an ambient surrounding air temperature of 75 degrees Fahrenheit, the specimen of core sample having front and rear fiberglass sheets exhibited a sag at its mid-point of only ⅜". The single sheet core sample correspondingly sagged ⅜", and the plain rockwool mat sample registered a sag of 1⅝".

These test results clearly demonstrate the effect of the fiberglass sheets in improving the sag resistance of the rockwool mat.

EXAMPLE 2

A core made in accordance with Example 1 but having a 2" thick rockwool mat was tested for compressive strength by placing the core specimen upon a flat horizontal support surface, and placing upon the uppermost fiberglass sheet of the specimen a flat platen of 3"×4" size supporting a 50 lb. weight. After standing two hours at an ambient temperature of 75 degrees Fahrenheit, the core sample registered a depression of 4/32". By way of comparison, the rockwool mat alone produced a corresponding depression of 8/32, or 12.5% compression.

In a slightly different manner of testing of compressive strength, it was found that the amount of weight required to compress the core sample by 12.5% was 98 pounds, namely almost twice the weight needed to produce the same compression in the rockwool mat alone.

EXAMPLE 3

A first core made in accordance with Example 1 and having front and rear fiberglass sheets was tested for sound absorption characteristics in accordance with ASTMC 423-90a. A noise reduction coefficient (NRC) was determined by measuring the sound absorption at 250, 500, 1000 and 2000 Hz frequencies, and averaging the results.

By virtue of such test, said first core of this example provided an NRC of 0.95. By way of comparison, a second core, similar to said first core but having only one fiberglass sheet, yielded an NRC of 0.90. By way of further comparison, the rockwool mat alone, as employed for the production of the first and second core samples of this example, was similarly tested and found to have an NRC of 0.85.

Such data establishes that attachment of the fiberglass sheets to the rockwool mat surprisingly enhances the noise reduction coefficient of the core.

EXAMPLE 4

A core made in accordance with Example 1 using two fiberglass sheets was tested for surface burning characteristics by ASTM test method E84-89a. The purpose of this method is to determine the relative burning behavior of a material by observing the rate of flame spread along the specimen. Results are reported as a Flame Spread Index which compares the tested specimen with a mineral fiber cement board standard, assigned a Flame Spread Index of 0 and red oak flooring standard, assigned a Flame Spread Index of 100.

Such testing showed that the core specimen had a Flame Spread Index of 10 whereas the rockwool mat alone had a Flame Spread Index of 25. Such results prove that the addition of fiberglass sheet to the rockwool mat unexpectedly enhances fire retardancy.

While particular examples of the present invention have been shown and described, it is apparent that changes and modifications may be made therein without departing from the invention in its broadest aspects. The aim of the appended claims, therefore is to cover all such changes and modifications that fall within the true spirit and scope of the invention.

Having thus described my invention, what is claimed is:

1. A core for the production of a rectangular acoustic panel, said core comprising:

a) a shape-retaining, self-supporting mat of rockwool bounded by flat front and rear surfaces and four straight perimeter edges disposed in a rectangular array, said mat having a density between 5 and 9 pounds per cubic foot (lbs./cu.ft.), a thickness between 0.75 and 2.0 inches, and a binder content of between 3% and 5% by weight of said mat, and b) a sheet of non-woven interbonded fiberglass adhered to at least one flat surface of said rockwool mat, said sheet having a thickness between 20 and 30 mils and a weight between 0.75 and 3.0 ounces per square foot.

2. The core of claim 1 wherein both flat surfaces of said rockwool mat have said sheet bonded thereto.

3. The core of claim 1 wherein said sheet of fiberglass is comprised of continuous length borosilicate glass fibers laid in a swirl pattern and interadhered with a non-discoloring bonding agent.

4. The core of claim 1 wherein the flat surfaces of said mat of rockwool are produced by a slicing operation which produces the mat from a larger structure of rockwool.

5. The core of claim 1 having a noise reduction coefficient greater than 0.85.

6. The core of claim 5 having a flame spread index smaller than 25.

7. The core of claim 6 having a greater sag resistance than the sag resistance of the mat of rockwool alone.

8. The core of claim 7 having greater resistance to compressional deformation than the mat of rockwool alone.

9. A core for the production of a rectangular acoustic panel, said core comprising:

a) a shape-retaining, self-supporting mat of rockwool bounded by flat front and rear surfaces and four straight perimeter edges disposed in a rectangular array, said mat having a density between 5 and 9 pounds per cubic foot a thickness between 0.75 and 2.0 inches, and a binder content of between 3% and 5% by weight of said mat, and b) a sheet of non-woven fiberglass adhered to at least one flat surface of said rockwool mat, said sheet having a thickness between 20 and 30 mils and a weight between 0.75 and 3.0 ounces per square foot, said sheet being comprised of continuous length borosilicate glass fibers laid in a swirl pattern and interadhered with a non-discoloring bonding agent, said sheet having a tensile strength greater than 25 pounds/inch, and an Elmendorf tear strength greater than 350 grams.

* * * * *